US005221809A

United States Patent [19]

Cuadros

[11] Patent Number: 5,221,809

[45] Date of Patent: Jun. 22, 1993

[54] NON-LETHAL WEAPONS SYSTEM

[76] Inventor: Jaime H. Cuadros, 2742 Fragancia Ave., Hacienda Heights, Calif. 91745

[21] Appl. No.: 867,467

[22] Filed: Apr. 13, 1992

[51] Int. Cl.[5] ..... F42B 8/02; F42B 8/12

[52] U.S. Cl. ..... 102/439; 102/444; 102/502; 102/517; 102/523; 102/529

[58] Field of Search ..... 102/395, 444, 439, 498, 102/502, 517, 518, 523, 529; 273/418

[56] References Cited

U.S. PATENT DOCUMENTS

| | | | |
|---|---|---|---|
| 3,311,061 | 3/1967 | Roehrdanz | 102/523 |
| 3,528,662 | 9/1970 | Mechant et al. | 273/418 |
| 3,732,826 | 5/1973 | Johnson | 102/444 |
| 3,834,311 | 9/1974 | Mawhinney | 102/444 |
| 3,952,662 | 4/1976 | Greenless | 102/502 |

FOREIGN PATENT DOCUMENTS

| | | | |
|---|---|---|---|
| 1453821 | 2/1969 | Fed. Rep. of Germany | 102/529 |
| 2516579 | 10/1976 | Fed. Rep. of Germany | 102/502 |

*Primary Examiner*—Harold J. Tudor
*Attorney, Agent, or Firm*—Sanford Astor

[57] ABSTRACT

The invention relates to a non-lethal projectile of small mass for military or police use adapted to be fired from a standard launcher which projectile either increases in size during flight or at impact to spread the force over a large area to provide a knock-down-effect without body penetration.

5 Claims, 12 Drawing Sheets

FIG. 4
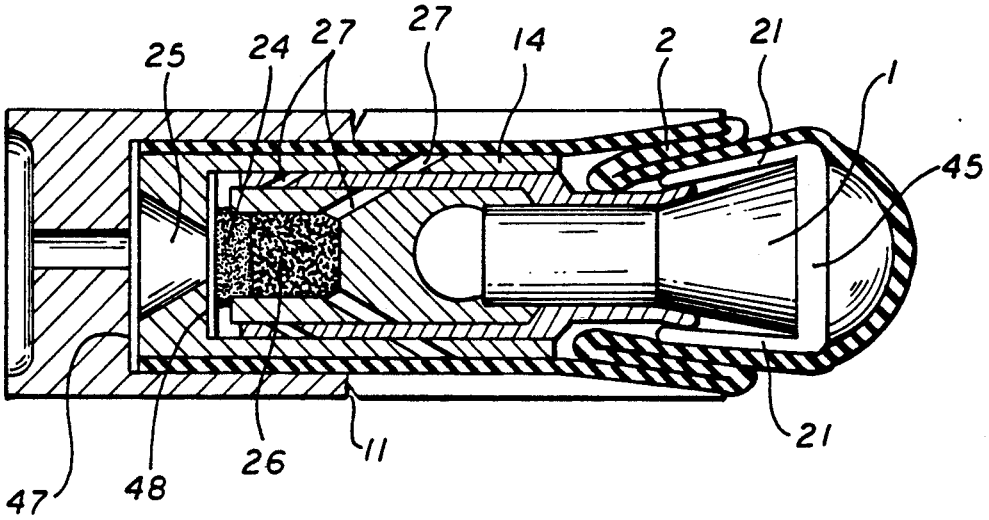
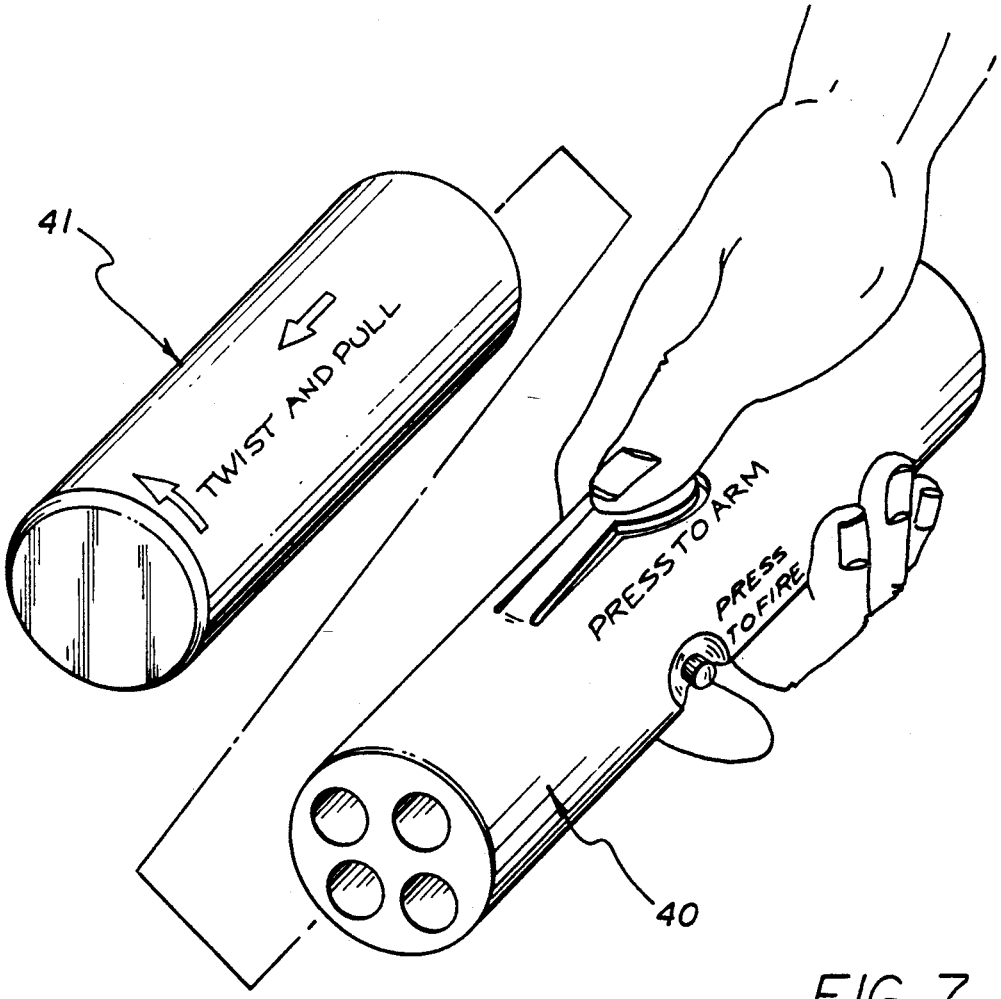
FIG. 7

PROBABILITY OF PENETRATING TISSUE AND CLOTHING AS A FUNCTION OF PROJECTILE PARAMETERS

SCATTER PLOT: FOUR-PARAMETER PROJECTILE-INDUCED BLUNT TRAUMA MODEL

SCATTER PLOT: FOUR-PARAMETER MODEL COMPARED TO INDEPENDENTLY OBTAINED DATA (n=93)

CONTINUOUS PROBABILITY PLOT.
LETHALITY AS A FUNCTION OF $MV^2/WD$ DOSE

FIG. 14

COMPARISON OF SOME LETHAL AND NON-LETHAL PROJECTILES

| PROJECTILE | WEIGHT, LB F | DIAMETER, IN. | IMPACT AREA, SQ. IN. | VELOCITY @0 FEET, FT/S | VELOCITY @20 FEET, FT/S | KE@20', FT-LB | KE AREA, FT-LB/SQ. |
|---|---|---|---|---|---|---|---|
| BB | .00125 | .18 | .025 | 1100 | 970 | 18 | 730 |
| .22 | 40 GR | .22 | .038 | 1100 | 1075 | 108 | 2841 |
| .45 | 230 GR | .45 | .159 | 810 | 802 | 337 | 2118 |
| BASEBALL | .34 | 3. | 3.14 | 109 | 88 | 41 | 13 |
| BASKETBALL | 1,25 | 9.5 | 23 | 62 | 44 | 38 | 2 |
| SHOTBAG | .187 | .71 | 1.77 | 225 | 185 | 100 | 56 |
| NON-LETHAL BULLET | .132 | 2. * | 3.14 | 225 | 179 | 66 | 21 |

* EXPANDED IN FLIGHT

NON-LETHAL WEAPONS SYSTEM

This invention is described in my Disclosure Document filed with Patent Office on Oct. 29, 1991.

BACKGROUND OF THE INVENTION

For the past 20 years, the law enforcement community has been searching for a projectile or missile that is non-lethal, for use in circumstances that do not require lethal force. A number of devices have been developed for this purpose but only a few have been sufficiently successful to be accepted by that community. Some of these devices use a shotgun-size or larger caliber dedicated launcher, to project a solid, soft projectile; others use a smaller caliber launcher with variations of the rubber bullet concept, to inject a tranquilizer drug or just stun the target person. Other methods used include fire hoses, water cannon, mace, pepper spray and a variety of electric shock inducers. The most common devices are the tear-gas grenade and the stun-grenade. These grenades are used in riot and multiple assailant situations, not usually in one-on-one situations, which are the most common confrontations.

The mechanism used in propellant actuated devices utilizes the momentum of the projectile to stun or knock down the target person. The dispersal of a marking substance at impact is a generic benefit that allows for subsequent identification and arrest of the subject law violator.

A projectile of relatively small mass, but with large surface area (like a basketball), when launched with sufficient velocity, and impacting the target at a short range, can produce the knock down effect. The impact force is distributed over a relatively large area, thus reducing damage to the target person. If the size of the projectile is reduced to that of a baseball, (and the mass reduced proportionally) the velocity required to produce the knockdown effect is reduced, but the impact is distributed over a smaller area, increasing the potential for more local damage to the target person. If the size of the projectile is reduced to that of a ball bearing, with a proportional mass, even at relatively small velocities it can penetrate the target, and at conventional gun velocities, it becomes a lethal bullet.

An ideal low-lethality projectile would balance the area of impact, the mass of the projectile and the velocity at impact, in order to produce the desired stunning and knockdown effects, without penetrating or causing major damage to the target.

SUMMARY OF THE INVENTION

This invention comprises a non-lethal or low-lethality projectile system consisting of an expanding projectile fired from a dedicated launcher mechanism, to deliver a large momentum impulse to the target, without perforating it or causing a deep penetration. The effect of this momentum transfer from the projectile to the target, is to knock down the target person, without inflicting lethal damage.

Past efforts in this area have included rubber bullets and similar projectiles, that remain at a constant diameter from launch to impact, only changing diameter as a result of the impact deformation.

The projectile in this invention comprises a woven bag that is collapsed to fit in the diameter of the launcher. The front of the bag restrains a metallic ball (or projectile shaped body or small balls) that provide the impact mass and the forward location of the center of gravity of the assembly. The projectile is ejected form the launcher by igniting the propellant in the cartridge in the conventional way. The pressure developed by the propellant pushes on a sabot that carries the projectile and part of that pressure is bled into the woven bag, through a valve. The bag inflates after exiting the muzzle of the launcher. The shape of the inflated bag will stabilize and slow down the projectile in flight. There is a center body inside the bag, that carries the valve and supports the metallic ball at launch.

An alternative to the inflated bag shot is a method in which the bullet-bag combination functions at a lower energy level but in a similar way to a conventional bullet with a Kelvar vest on the target, except that the bullet carries the vest in front of it. This embodiment introduces the concept of a larger ball mass and adjusting the design launch velocity to meet the momentum requirements to knock down the target.

A .45 caliber, 230 grain bullet, fired at 835 feet per second, has 351 ft-lbs of kinetic energy and 27 ft-lbs per second of momentum at 25 feet down range. The kinetic energy (KE) provides the penetration power, the momentum provides the knockdown power. If there is no deformation of the .45 bullet, the KE per square inch at impact (25 feet) is approximately 2200 ft-lbs per sq. in. To avoid penetration, the KE should be about 125 ft-lb per sq. in. A 2 sq. in. projectile can impact with less than 250 ft-lbs KE to stay below the 125 ft-lb/sq. in. desired level of energy on target. A 0.1 lb projectile, fired at 200 ft. per sec. with an impact area of 4 sq. in., has a probability of 0.0068 of penetrating bare skin. The same projectile at the same velocity but with an impact area of 0.2 sq. in., has a probability of 0.9979 of penetrating the skin, as computed by the Lewis method (the industry standard).

DESCRIPTION OF THE DRAWINGS

Other objects, uses and advantages of the invention will be obvious from the following description and drawings in which the reference numerals indicate like parts throughout the several views.

The drawings consist of:

FIG. 4 is a cross-sectional view of another embodiment;

FIG. 7 is a perspective view of a launcher;

FIG. 14 is a summary table.

FIGS. 1*a* and 1*b* illustrate the longitudinal cross-section of the projectile assembly, in the simplest embodiment. FIG. 1*a* is the cross-section of the complete assembly, before firing, and FIG. 1*b* is the cross-section of the projectile in flight. The front metallic body 1 of the projectile provides the mass for the momentum transfer to the target, and stability during flight. The proper design of this body, will locate the center of gravity at the correct place to provide stability and allow room to fold or store the balloon or bag 2, prior to firing. This assembly is encased in a sabot 6. The sabot has 4 (or 8) petals 3 created by slitting the walls of the front part of the sabot 6. There is a groove 11 around the periphery to act as a hinge and allow the petals 3 to open after leaving the launcher barrel. The forces which open the petals 3 are the aerodynamic drag and the inflating gas pressure in the bag 2.

The bag 2 is fastened to the central support body 4 by any convenient method, such as bonding with an adhesive. The total combined length of the front metallic body 1 and the central support body 4 is substantially equal to the length of the projectile, as shown in FIG. 1*a*. Body 4 has several cavities and houses the one-way valve assembly 5. The cavities include a low pressure chamber 10 and four (or eight) ports or tunnels 12 connecting the low pressure chamber 10 to the space inside the bag 2. Upon ignition of the propellant 8, high pressure gases pass through entry port 42 through seal 43 through one-way valve 5 and into low pressure chamber 10, then through ports 12 into bag 2. The low pressure gases passing through these ports 12 inflate the bag 2. As the projectile moves away from the launcher, the launching pressure behind the projectile drops rapidly, the one-way valve 5 closes, due to the now higher pressure inside the bag 2. After the valve 5 closes, the pressure trapped in bag 2 will keep it inflated during the flight to the target. The pressure inside the inflated bag 2 is what provides the large frontal area necessary to spread the load at impact, and keep the projectile from penetrating into the target. Referring to FIG. 1*a*, the cartridge case 9 is shown with the primer 7 and the propellant 8. The cartridge case 9 is a modified standard case at the selected caliber. The case is modified so that a lethal projectile cannot be placed in the launcher by mistake. The modifications could include a change in the shape (by tapering) or change in diameter to match the shape of the chamber in the launcher barrel. The head space could also be different than the equivalent conventional cartridge-bullet combination. This unique shape design and head space difference is desired to preclude the loading and firing of a conventional lethal round of the same caliber. The launcher can be a modified conventional gun in 9 mm. 10 mm. or .45 caliber (or larger) or a specially designed launcher at whatever caliber provides the best compromise in the projectile velocity-mass parameters. The launch medium may be a conventional propellant in a cartridge, as described above, or compressed gas (CO2) in an specially designed launch system similar to conventional compressed air guns.

FIGS. 2*a* and 2*b* illustrate another embodiment of the non-lethal projectile, in the stowed position (2*a*) and in flight (2*b*). The projectile comprises the metallic projectile 1, the central support body 4, imbedded in a base 13 that attaches the projectile assembly to the sabot 6. Cavity 15 between the base 13 and the support body 4 is the cavity where a petal deployment slider 14 slides from the retracted position shown in FIG. 2*a* to the deployed position shown in FIG. 2*b* by gas pressure from the burning propellant. This gas pressure enters by blowing a seal 22, passing into the low pressure chamber 10 and into cavity 15. The pressure in cavity 15 pushes the slider 14 forward. The front of slider 14 rides up the cam surface of the metallic projectile body 1, and pushes petals 21 up until slider 14 locks up in the cavity 19 formed by the metallic projectile 1 and the ring 45 that holds the petals 21. Petals 21 deploy the bag 2. When sliders 14 are fully deployed forward, a port 46 in each slider 14 lines up with the ports 12 in the support body 4 and base 13 allowing gases to pass into bag 2. The bag 2 is folded and stored in space 23 between the slider 14 and the sabot 6.

FIGS. 3*a* and 3*b* illustrate an alternative to pressurizing the bag 2 which is to replace the back of the bag 2 with 17, 20 connecting the front of the bag to base 13. These strings can be stowed away as shown at 20 and are attached to the 13 by any convenient method such as bonding. The excess from the front face of the bag 2, can be stored in the space 2 the petals 3 and the launcher barrel. A seal 22 the propellant from getting into low pressure chamber 10.

Figure 1A:
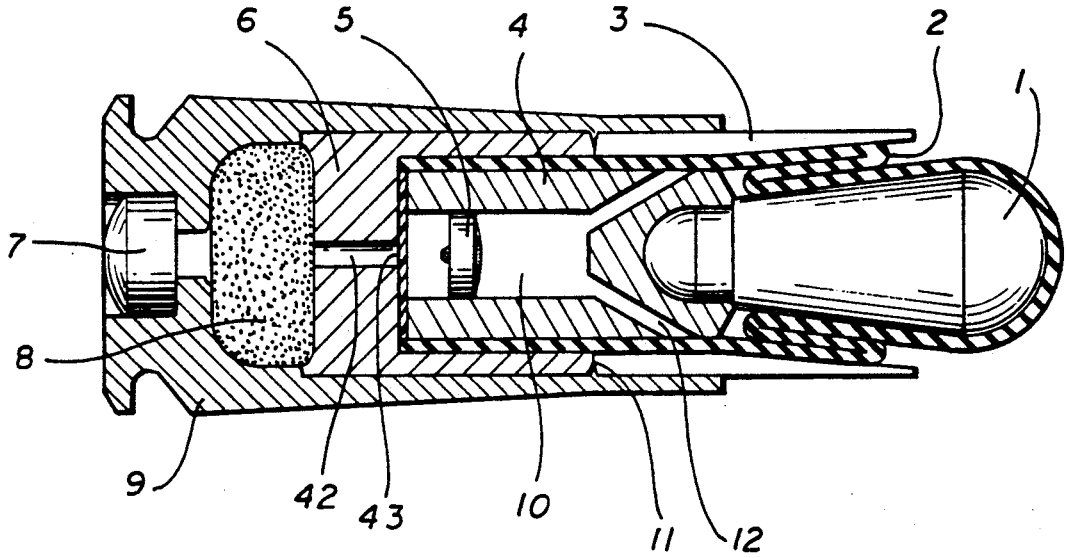
FIGS. 1*a* and 1*b* are a cross-sectional view of a projectile of this invention.
Figure 1B:
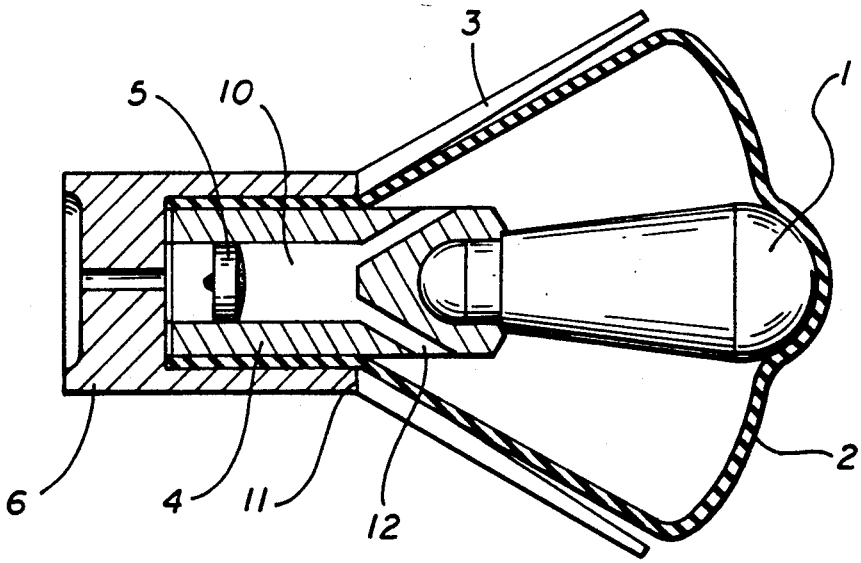
Figure 2A:
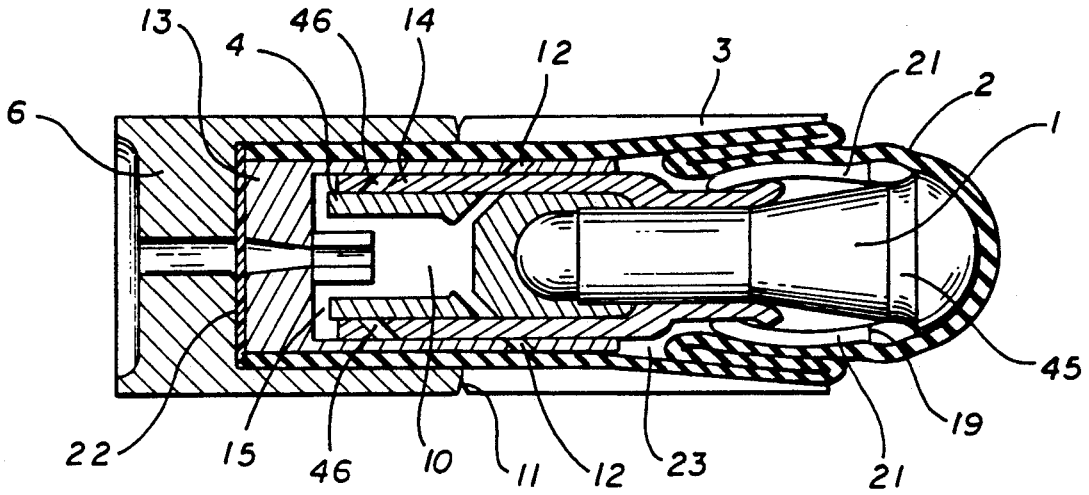
FIGS. 2*a* and 2*b* are a cross-sectional view of another embodiment.
Figure 2B:
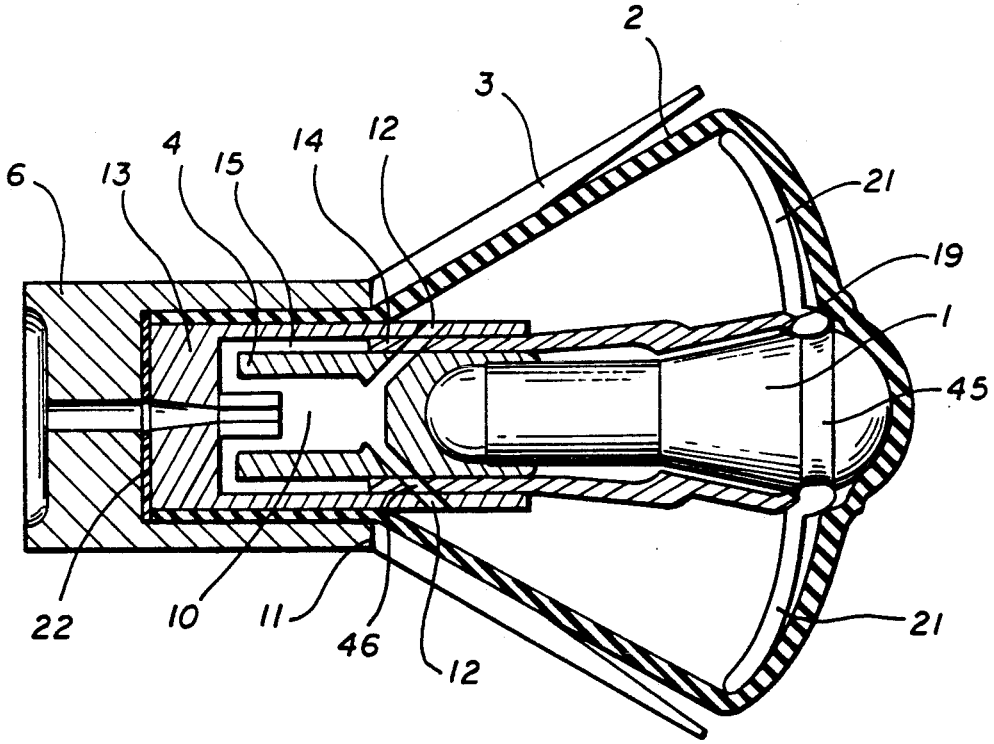
Figure 3A:
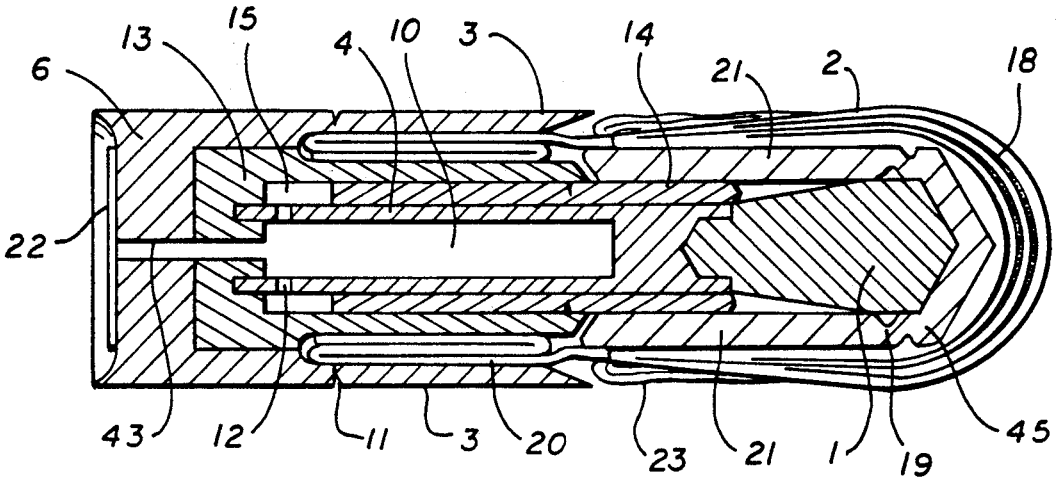
FIGS. 3*a* and 3*b* are a cross-sectional view of another embodiment.
Figure 3B:
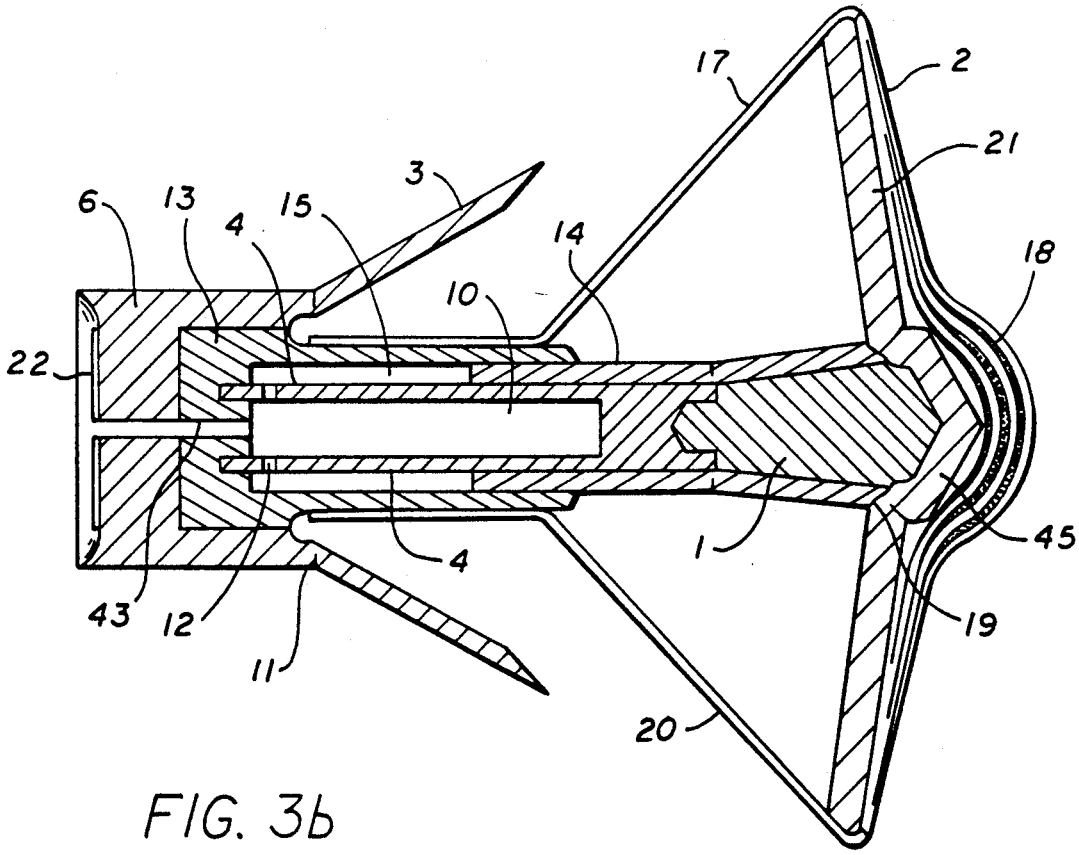

A variation in this arrangement is design the launcher so that the front portion of the projectile is left outside of the very short barrel of the launcher, but protected by a safety cap. Another variation is to relocate of the mass from the metallic projectile 1 to the front of the bag 2. This is accomplished by making a multi-layer front face 2, and inserting high density material 18 bet the layers. This high density material 18, Tungsten powder instance, would be suspended in an emulsion in order to main some flexibility over long storage time. The advantages of modification are the reduction in size of the metallic 1 and the redistribution of that mass into the front the bag 2. This action helps the aerodynamics of the projectile by moving the center of gravity forward and the momentum transfer to the target by distributing the mass over a larger area of the projectile.

Using this basic external structure, several variations can be utilized to apply the concept of energy release at impact (or just prior to impact) to effect the knockdown of the target with an acceptable level of damage to the target, without penetrating the body. There are three variations to be described; 1) the addition of a rocket motor to impart a short thrust pulse; 2) a low energy explosive mixture to provide the impulse into the target at impact; and 3) a degraded fuel-air explosive mixture to produce the same effect.

FIG. 4 shows the central body of the projectile, modified to have a nozzle 25 in the propellant cavity. A low burning-rate fuel mixture 24 is placed in the nozzle 25, to be ignited by the hot propellant gases from the firing cartridge. Seal 47 separates the propellant from the projectile. Seal 48 separates and supports the low-burning rate fuel 24 prior to ignition. Seal 48 allows hot propellant gases to enter and ignite low burning rate fuel 24. When fuel 24 completes its burning, it initiates the rocket motor propellant 26 which blows out the remanent of the time delay low burning rate mixture 24. The pressure from the rocket motor is bled through ports 27 to the space behind bag 2, to inflate it. Ports 27 are aligned by the motion of slider 14 that opens petals 21 that deploy bag 2. If the metallic projectile is made smaller, as described above, the cavity for the rocket motor propellant 26 can be made larger, if required, to get a larger impulse into the target.

Figure 5:
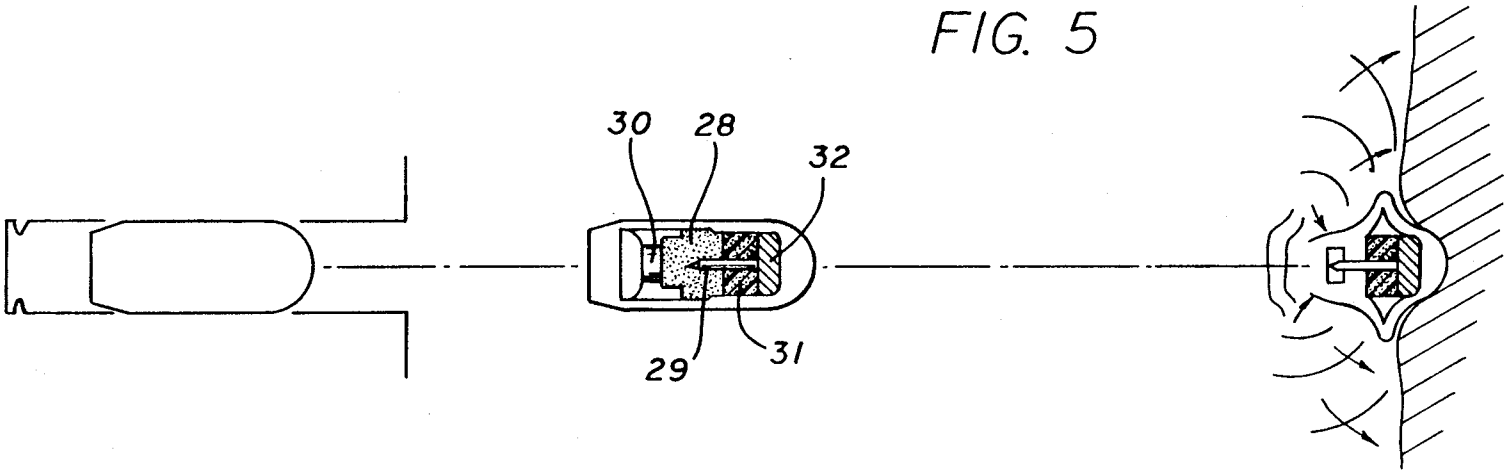
FIG. 5 is a cross-sectional view of another embodiment.

FIG. 5 is a representation of the degraded explosive concept. The degraded explosive component 28, is ignited by the impact of the nose 32 on the target and the rearward displacement of a striker or firing pin 29. This pin would initiate a percussion primer 30 which will propagate to the explosive 28 in the cavity. An alternate method for initiation is to have a blunt pin strike a rigid bulkhead coated with an initiating material, instead of a primer. An attenuator 31, such as polystyrene, is present to absorb shock waves from the explosive component 28 to reduce the damage to the target.

Figure 6:
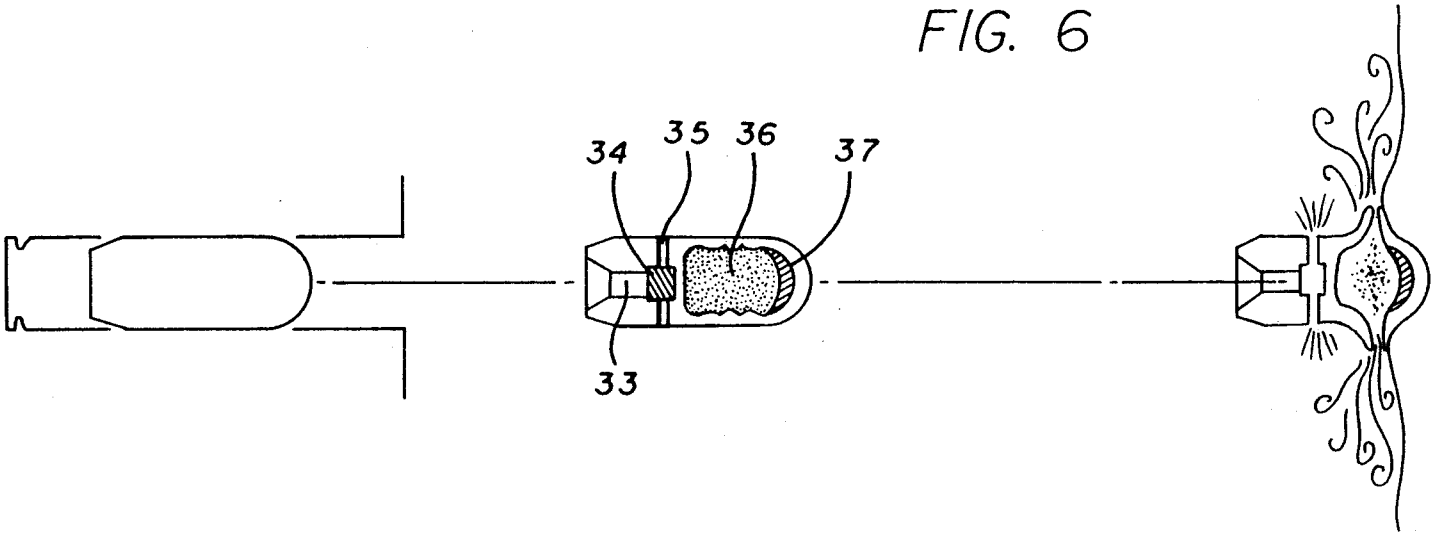
FIG. 6 is a cross-sectional view of another embodiment.

FIG. 6 shows one implementation of the fuel-air concept. The mechanism includes the fuel 36, the igniter 35, and the metallic projectile 37 in front. The intent of this mechanism is to compress and eject fuel 36 at impact and a very short time later, after it has mixed with ambient air, to ignite it. A pyrotechnic time delay 33 initiate by the propellant gases provides the source of ignition. Alternatively, this delay can be initiated at the same time as the impact that ejects the fuel 36. The characteristic of the fuel-air system is to press with constant high pressure in the direction of the target, and provide the impulse to knock the target down.

Conventional fuel-air fuels may not function well enough after being degraded by diluents and may require larger pressures to activate that can be generated by mechanical means. A pyrotechnic device can be incorporated into the ignition system to compress and shock the fuel before dispersing it. Alternatively the conventional fuel-air mixture can be replaced with a pyrotechnic mixture to perform the same function but at a reduced effectiveness as it will not have the long duration pressure pulse characteristic of fuel-air explosives.

The launcher can be a conventional pistol, but this has the problem of proper and prompt identification of the type of bullet loaded into the gun. There could be a time when a non-lethal bullet is required and the gun is inadvertently loaded with conventional lethal bullets or vice-versa. A dedicated launcher has the advantage of having special features that require a unique cartridge. This precludes the possibility of loading and firing a conventional lethal bullet by mistake. The dedicated launcher can be attached to the end of a police baton, and be ready for use without having to carry an additional device. FIG. 7 shows a four barrel launcher 40 in the shape of a cylinder. A protective cover 41 can be provided, as shown. Cover 41 is removed by twisting and pulling it off. This action arms or makes the system ready for use. The details of arming and firing each cartridge are part of the conventional state of the art, and the details are left to the launcher designer. Choices include the use of a single firing mechanism where you rotate the cylinder to bring the chamber with the cartridge into alignment or to use four separate arming and firing mechanisms, one for each barrel. The simplest, safest design should be utilized.

An alternative method is to provide the means to fire the same less-lethal projectile at a higher speed, thus making it a lethal projectile. The same result can be reached by inhibiting the deployment of the load spreading device, thus increasing the energy per area of contact. The simpler, more reliable method would be to provide two different cartridges with different loads, one for the less-lethal operation and the other with a higher load to produce the higher velocity that would make the same projectile a lethal projectile. Only one cartridge at a time would be loaded behind the projectile already in the chamber. This is similar to artillery rounds where the projectile is loaded in the gun, then the powder charges are loaded and the breech closed. Another alternative is to load higher velocity cartridges as the norm and then by twisting a portion of the launcher, ports could be opened to vent a large portion of the gases and thus reduce the velocity of launch. This method of venting can also be utilized to adjust the range capability of the device. Maximum range can be obtained with all the ports closed and minimum range obtained with all the ports open.

An added feature would be to include a marker ink in the projectile, so that when it opens up, the ink sprays the target to mark it. The ink could be contained in a small bag located in chamber 10.

The key element of the first embodiment of this invention is that the projectile comes from the standard bore size of the launcher and expands in flight, prior to impact, to enlarge the impact area and lower the energy per square inch on impact.

The second method involves means to release energy just prior to or at impact to add force to the impact over a larger area. Thus the projectile travels at a lower velocity and energy is added at impact.

Since the 1960's, a number of studies have been conducted to determine the limits of lethality for projectiles impacting human bodies and the parameters that correlate to the threshold of lethality Most of these studies were conducted for military applications. The automobile industry has had an ongoing program to improve survivability in automobile crashes by quantifying the effects of blunt trauma and non penetrating impacts, among other events occurring in auto accidents. From this research comes a methodology to quantify the effect of chest compression and blunt trauma from impacting objects into the chest area.

For the purposes of this invention, the principal area of interest is the lethality of a low velocity projectile, of larger diameter and mass than a lethal bullet, impacting on a human target. The damage inflicted on the target varies with the location of the impact (i.e. the extremities, the head, the thorax, the abdomen, and with the direction of impact (i.e. from the front, the back, etc.) The extremities are less vulnerable but the eyes, temples and larynx are more vulnerable and more dependent on the area of the projectile at impact. The bulk of the data available deals with impacts to the thorax, and as applicable, will be used to define the limits for the projectiles of this disclosure.

Figure 8:
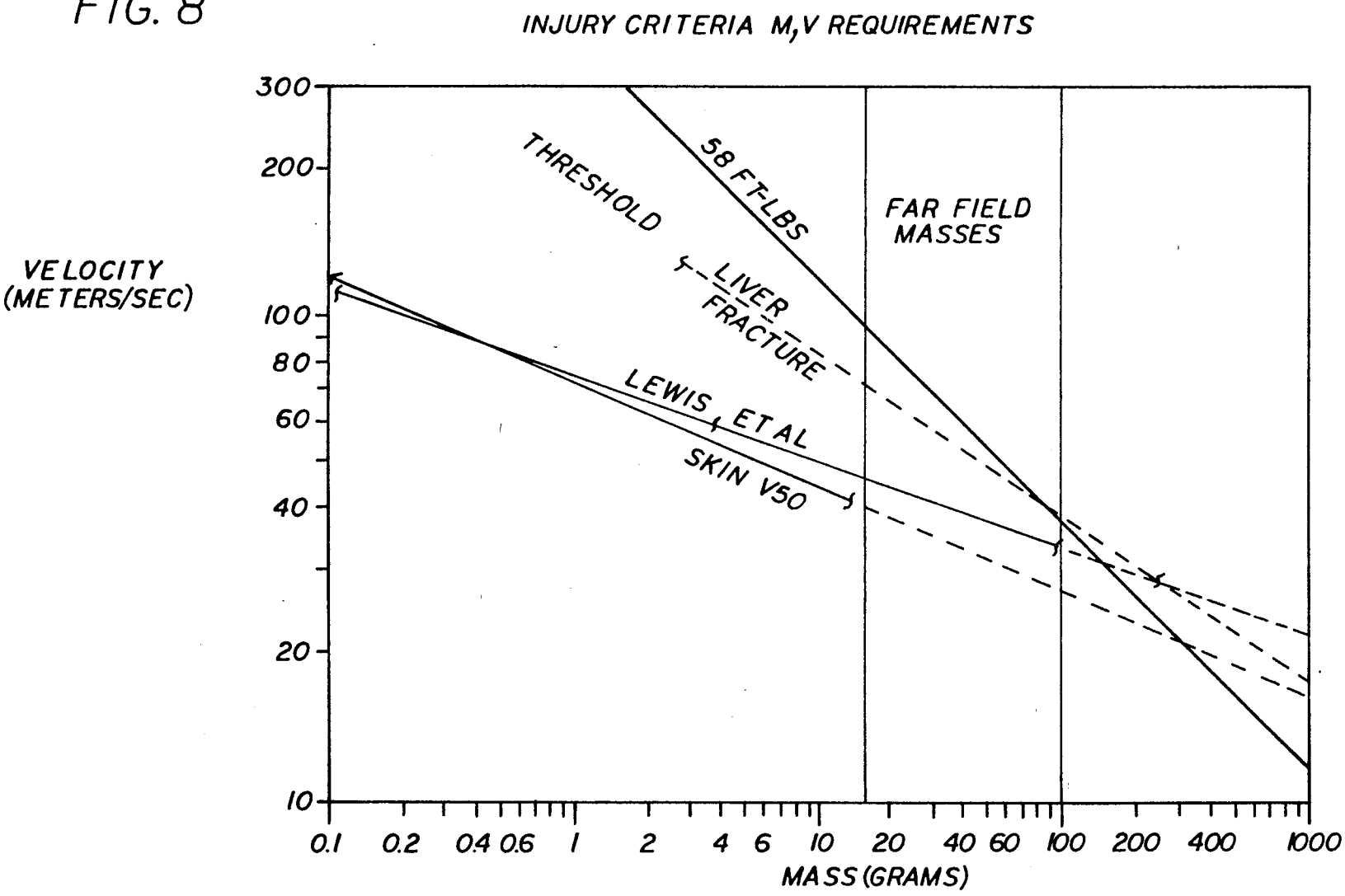
FIG. 8 is a graph of injury criteria.

Some of the key results of work done by the Government Labs in survivability of low velocity projectile impacts are summarized in FIG. 8. FIG. 8 presents the different injury criteria as related to the mass and velocity of the projectile. The line labeled "58 ft-lbs" is the oldest empirical observation (H Rohne, circa 1896) referring to the kinetic energy required to remove a human from the battlefield. The liver fracture curve is from experimental data correlating the threshold of liver damage to the velocity, mass and area of the projectile vs. the mass of the target individual. The equation is:

$$Vc=0.632 \text{ sqr } ((w*D)/m)$$

where:

V=Critical velocity, m/s
m=mass of projectile, Kg
D=Projectile diameter, cm
w=Body mass, Kg The line labeled "Lewis et. al." in FIG. 8 represents the probability of penetrating the skin, plotted from the empirical equation derived by Lewis, et al. The equation is:

$$P=1/(1+\exp(-(\text{alpha}+\text{beta}*\text{Ln}((m*vz)/A))))$$

where:

P=Probability of skin penetration
m=Mass of fragment, gm
v=Fragment velocity, m/s
A=Average fragment size, cm2
Alpha=−28.42
beta=2.94

Figure 9:
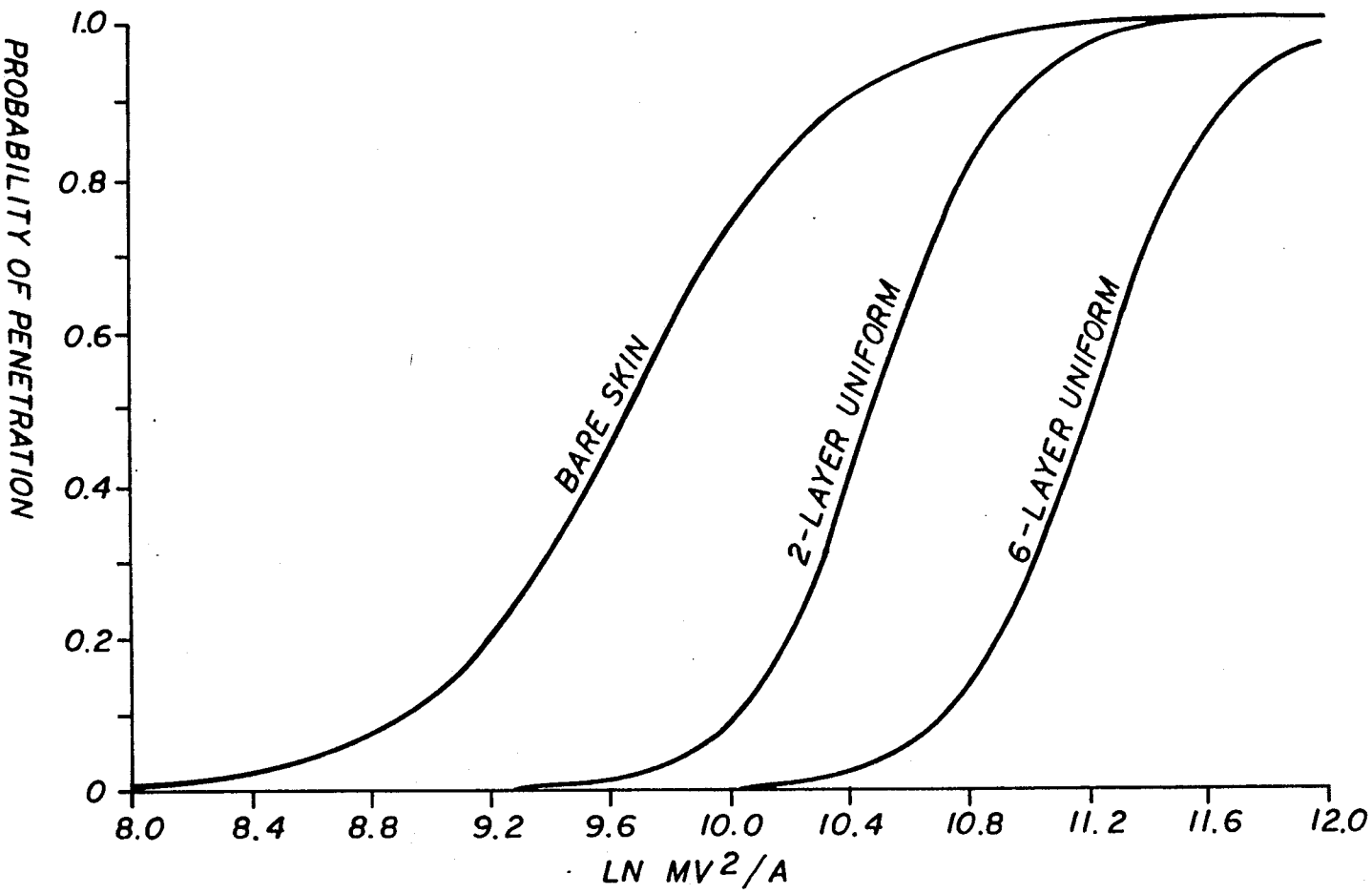
FIG. 9 is a plotting of injury criteria.

The line labeled "skin V50" represents the combination of mass and velocity of the projectile where there is a 50% probability of penetrating the skin, as computed with this equation. FIG. 9 shows the plotting of these computated values and, with different coefficients, the computations for the probability of penetrating bare skin, skin plus a two layer uniform, and skin plus a six layer uniform. The data in these two graphs sets upper level boundaries for projectile velocity, mass and impact area to stay below the lethal threshold level. The "Handbook of Human Vulnerability Criteria" Chapter 9. Projectile-induced Blunt Trauma. Edgewood Arsenal Special Publication EB-SP-76011-9, May 1976 describes a multiple parameter correlation model, where the four previously described parameters are interrelated in a different way. The parameters are M=Mass of projectile, grams
V=Velocity of projectile, m/s
D=Diameter of projectile, cm
W=Mass of animal, kg The relationships are defined as:

$$\ln(MV^2)-\ln(WD)=\ln(MV^2/WD)=A$$

When these parameters are plotted in log graphs, there are two lines determined by the range of values of A.

$MV^2/WD<A1$; Safe Zone $A1<MV2/WD<A2$ ; 50—50 Zone $MV^2/WD>A2$; Lethal Zone where:

A1=2,000
A2=3,000

Figure 10:
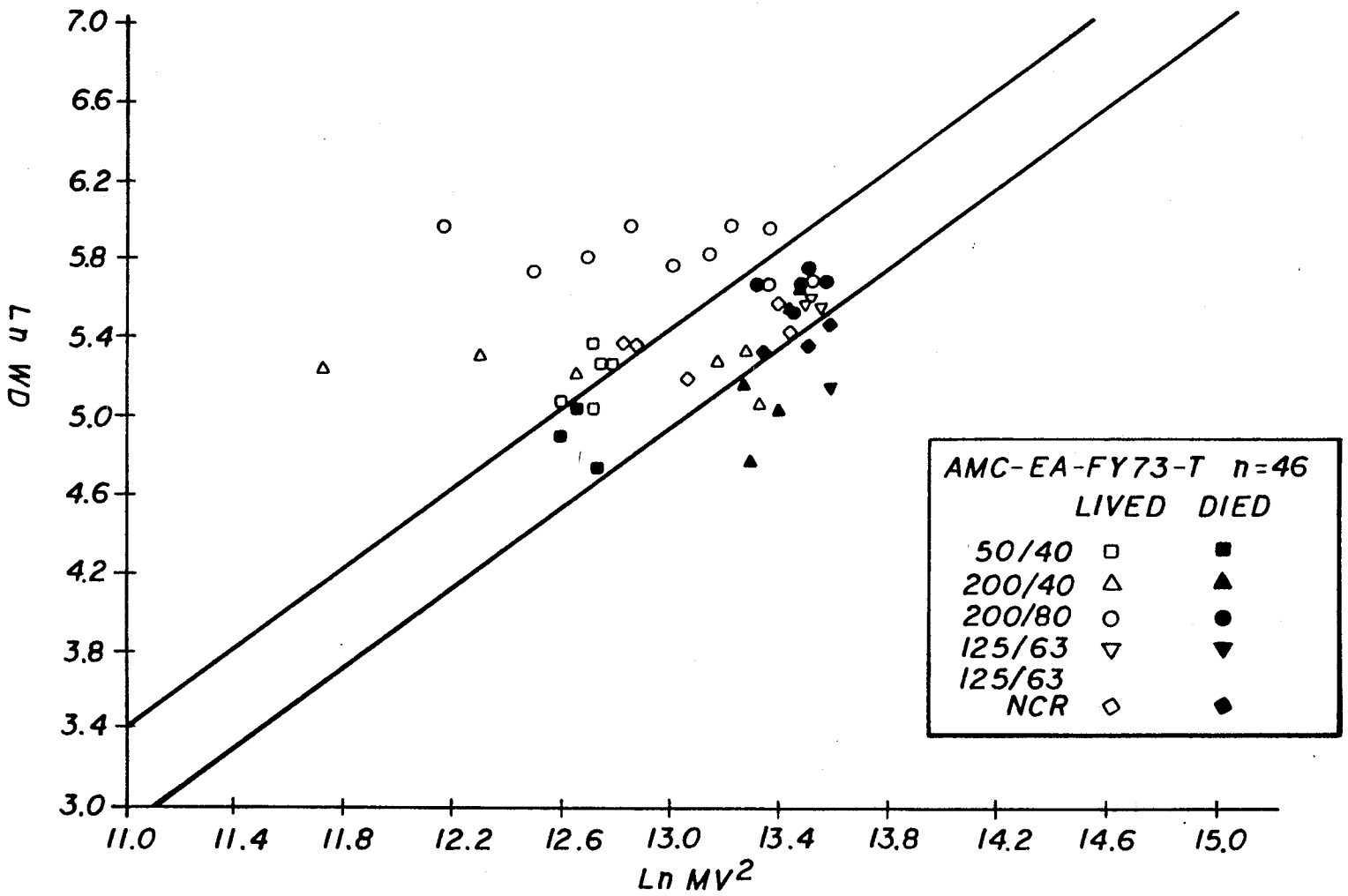
FIG. 10 is a plotting of injury experiments.
Figure 11:
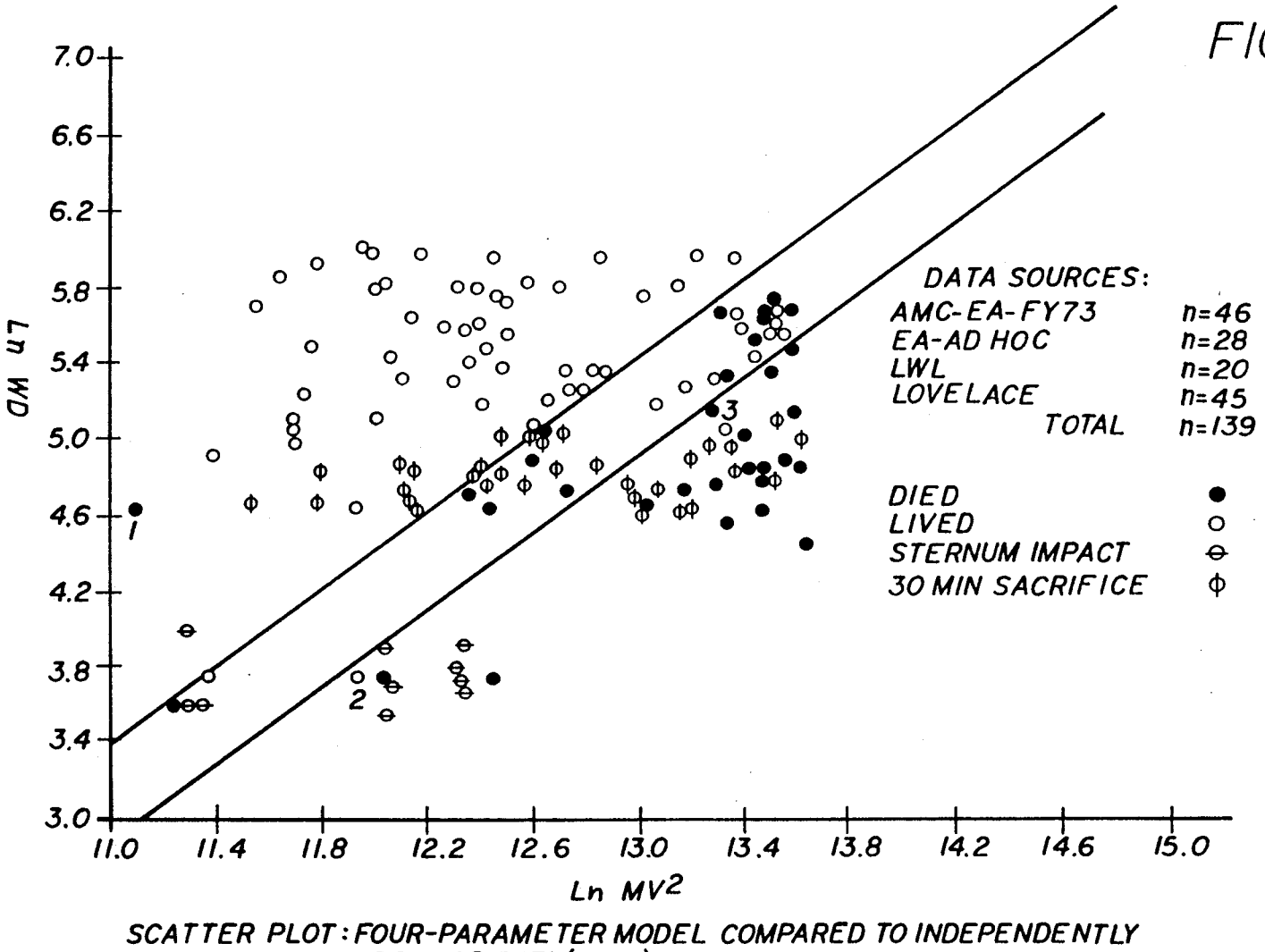
FIG. 11 is a plotting of injury experiments.

FIG. 10 presents the plottings of 46 experiments conducted at Edgewood Arsenal. FIG. 11 present the results of total of 139 experiments, the 46 from Edgewood Arsenal plus 93 other experiments performed by other independent labs. All of these experiments were for blunt trauma projectiles. The majority of these experiments involved impacts to the rib cage over the lungs, but a few shots were over the sternum, with the heart as the target organ.

The probability of lethality can be computed by the same probability equation presented above, for the four parameters of projectile velocity, mass, diameter and target mass. The coefficients for this correlation are different than those presented earlier, thus:

alpha=34.90
beta=−4.39

Figure 12:
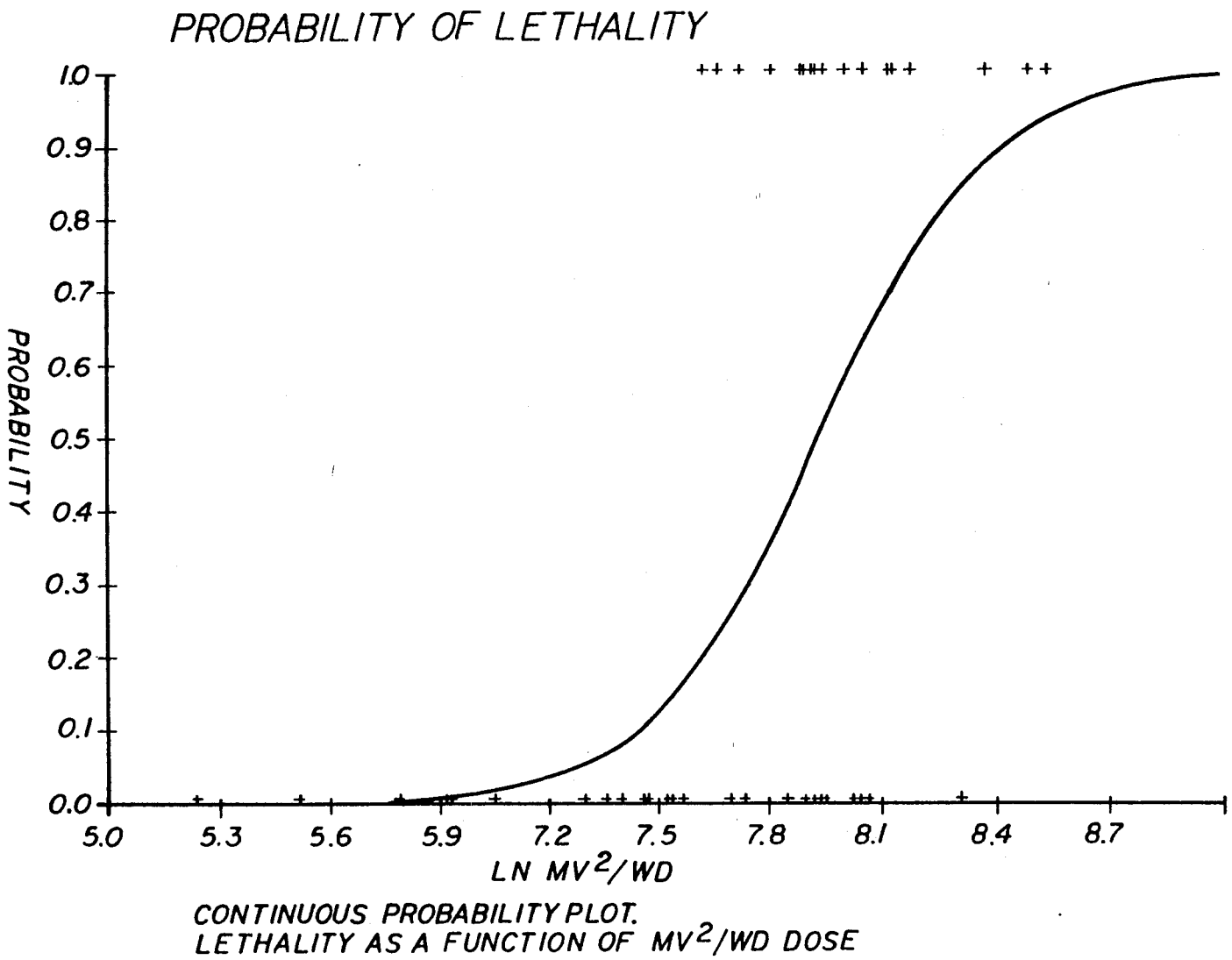
FIG. 12 is a graph of lethality probability.

FIG. 12 is a plotting of lethality as a function of the four parameters, M, V, W, and D.

Figure 13:
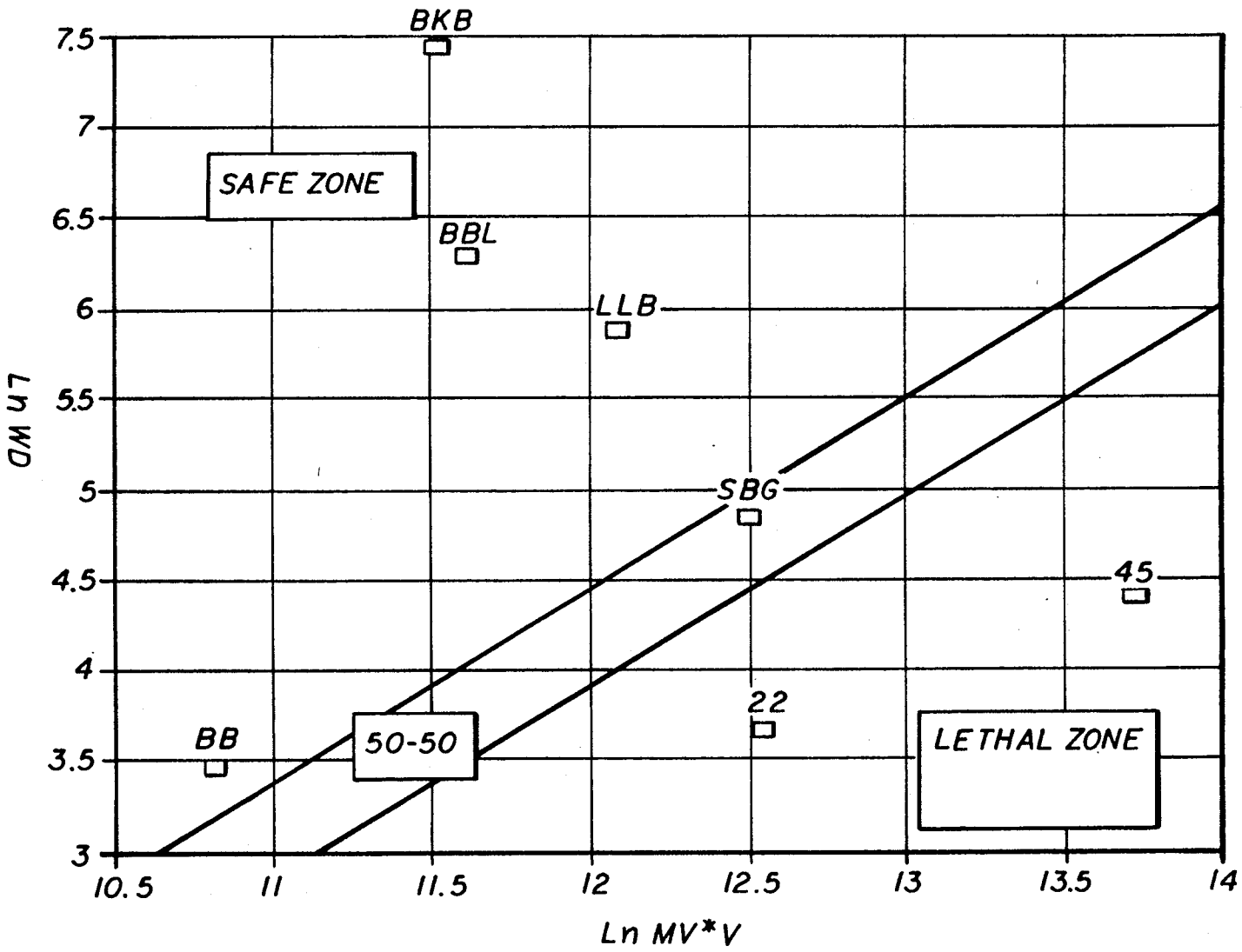
FIG. 13 is a plotting of lethality.

With the above guidelines in mind, the computations and plottings were made for different configurations of the proposed projectile, varying the impact area, (load spreader deployed and not deployed) the velocity, at the muzzle of the launcher and at 20 feet range. The plot for this 20 foot value is shown in FIG. 13. FIG. 13 is a plot of Ln WD vs. Ln $MV^2$, showing the lethal zone, the safe zone and the 50–50 zone. As a comparison, the same computations were made for other lethal and non-lethal projectiles launched at their characteristic velocities, but slowed down to the 20 foot range. These projectiles are: a BB fired from a shotgun, (symbol BB), a .22 bullet (symbol 22), a .45 bullet (symbol 45), a baseball (symbol BBL), a basketball (symbol BKB), a shotbag (symbol SBG), and the Less than Lethal Bullet (symbol LLB). FIG. 14 summarizes some of these computations for comparison. Some of the key assumptions are tentative, such as the impact area. For the bullets, the diameter of the bullet was selected as the impact area; for the non-lethal items, a judicious area was selected, taking into account some compression of the soft tissues. Overall, the plotting of the results fall where expected in the lethal zone or the safe zone.

Having thus described the invention;

I claim:

1. A non-lethal cartridge comprising a non-lethal projectile and a propellant charge; said projectile comprising a sabot located within said cartridge, an inflatable bag located within said sabot, a substantially cylindrical member within said bag, mass body means, within said bag, connected to said substantially cylindrical member, the total combined length of said substantially cylindrical member and said mass body means being substantially equal to the length of the projectile, said propellant charge emitting gases, said substantially cylindrical member having port and valve means for inflating and holding a portion of said gases within said bag during flight to expand said inflatable bag to a size substantially larger than the bore of the cartridge.

2. The device of claim 1 in which said sabot comprises a plurality of petals which spread open as said bag inflates.

3. The device of claim 1 comprising a one-way valve which allows gases to flow into said bag and be held therein.

4. A non-lethal cartridge comprising a non-lethal projectile and a propellant charge, said projectile comprising a sabot located within said cartridge, an inflatable bag located within said sabot, a substantially cylindrical member within said bag, mass body means, within said bag, connected to said substantially cylindrical member, the total length of said substantially cylindrical member and said mass body means being substantially equal to the length of the projectile, said propellant charge emitting gases, said substantially cylindrical member having port means for inflating said bag with a portion of said gases during flight to expand said bag to a size substantially larger than the bore of the cartridge.

5. The device of claim 1 comprising a plurality of internal petals located inside of said bag, a slider which spreads open said internal petals, said slider thrust forward by the pressure of said gases.

* * * * *